US009573750B2

(12) United States Patent
Seling et al.

(10) Patent No.: US 9,573,750 B2
(45) Date of Patent: Feb. 21, 2017

(54) AEROSOL CONTAINER WITH REMOVABLE OUTLET VALVE

(71) Applicants: Kerstin Seling, Doerfles-Esbach (DE); Walter Franz, Germuenda (DE)

(72) Inventors: Kerstin Seling, Doerfles-Esbach (DE); Walter Franz, Germuenda (DE)

(73) Assignee: THOMAS GMBH, Langenselbold (DE)

( * ) Notice: Subject to any disclaimer, the term of this patent is extended or adjusted under 35 U.S.C. 154(b) by 168 days.

(21) Appl. No.: 14/444,312

(22) Filed: Jul. 28, 2014

(65) Prior Publication Data

US 2015/0034682 A1 Feb. 5, 2015

(30) Foreign Application Priority Data

Jul. 31, 2013 (DE) ..... 10 2013 108 195

(51) Int. Cl.
*B65D 83/00* (2006.01)
*B65D 83/48* (2006.01)
*B65D 83/38* (2006.01)

(52) U.S. Cl.
CPC ..... *B65D 83/48* (2013.01); *B65D 83/38* (2013.01)

(58) Field of Classification Search
CPC ..... B65D 83/48; B65D 83/38; B65D 83/40
USPC ..... 222/402.1
See application file for complete search history.

(56) References Cited

U.S. PATENT DOCUMENTS

| | | | | |
|---|---|---|---|---|
| 2,126,897 | A * | 8/1938 | Lamar | F16K 1/36 137/315.17 |
| 3,299,960 | A * | 1/1967 | Stern | B65D 83/48 116/106 |
| 3,598,292 | A * | 8/1971 | Kiliany | B65D 83/20 222/635 |
| 3,675,832 | A | 7/1972 | Ruscitti | |
| 3,819,090 | A | 6/1974 | Birrell | |
| 4,969,577 | A | 11/1990 | Werding | |
| 5,069,368 | A | 12/1991 | Godard | |
| 5,762,319 | A | 6/1998 | Kopp | |
| 5,927,313 | A * | 7/1999 | Hart | F16K 35/10 137/15.01 |
| 2009/0014679 | A1* | 1/2009 | Hygema | B65D 83/38 251/368 |
| 2011/0101036 | A1* | 5/2011 | Wanbaugh | B05B 11/3047 222/402.1 |
| 2015/0034682 | A1* | 2/2015 | Seling | B65D 83/48 222/402.1 |

(Continued)

FOREIGN PATENT DOCUMENTS

| | | |
|---|---|---|
| DE | 3807156 A | 9/1989 |
| FR | 2785594 B | 5/2000 |

(Continued)

*Primary Examiner* — Patrick M Buechner
(74) *Attorney, Agent, or Firm* — Andrew Wilford

(57) ABSTRACT

An aerosol container has a mouth centered on an axis. A plastic valve plate is fitted to and tightly attached to the mouth and has a disk formed with an outlet centered on the axis. An outlet valve is carried on the valve plate and has a housing holding a movable valve element. A rigid extension is integrally formed on the disk around the hole, projects axially into the container, and forms a cavity in which the housing of the valve is fitted. A seal is fixed in the cavity between the housing and a surface of the extension forming the cavity.

14 Claims, 12 Drawing Sheets

(56) References Cited

U.S. PATENT DOCUMENTS

| | | | | |
|---|---|---|---|---|
| 2016/0101925 | A1* | 4/2016 | Franz | B65D 83/48<br>222/402.25 |

FOREIGN PATENT DOCUMENTS

| | | | |
|---|---|---|---|
| FR | 2925032 | A | 8/2009 |
| JP | 09193978 | A | 7/1997 |
| JP | 09221183 | A | 8/1997 |
| WO | 8705279 | A | 9/1987 |
| WO | 2007107174 | A | 9/2007 |
| WO | 2011024553 | A | 3/2011 |

* cited by examiner

AEROSOL CONTAINER WITH REMOVABLE OUTLET VALVE

FIELD OF THE INVENTION

The present invention relates to an aerosol container. More particularly this invention concerns a cover and valve assembly for such a container.

BACKGROUND OF THE INVENTION

A standard aerosol container has a mouth to which is tightly attached a valve plate with an outlet valve having a valve plate made of plastic and formed as a disk with a hole for a valve element of the outlet valve.

An aerosol container with the described features is known from DE 38 07 156. The valve plate and the housing of the outlet valve are formed integrally of plastic. The aerosol container is also made of plastic and is welded to the valve plate. Aerosol containers made of metal, particularly tin or aluminum, are widely used. The valve plate is manufactured as a stamped or bent part out of tin or a sheet of an aluminum alloy and positively connected to the aerosol container by sheet-metal forming. The disk of the valve plate is a dome that forms a cavity for the housing of the outlet valve. The housing, a valve element with a valve shaft (stem) and a seal are inserted into the dome and fixed in the dome by crimping. The crimping results in a positive connection between the housing and the valve plate. An aerosol container with a metallic valve plate and an outlet valve attached thereto by crimping is known, for example, from DE 20 38 580 [U.S. Pat. No. 3,675,832] and FR 2 925 032.

In practice, aerosol containers are manufactured in separate process steps in which the container, the valve plate and the outlet valve are frequently produced by different companies. The housing of the outlet valves usually have similar and sometimes even standardized dimensions. They usually have a head with a front-side seal that can be inserted into a dome-shaped cavity of the valve plate.

OBJECTS OF THE INVENTION

It is therefore an object of the present invention to provide an improved aerosol container.

Another object is the provision of such an improved aerosol container that overcomes the above-given disadvantages, in particular that is where the valve plate made of plastic can be equipped with a separately manufactured outlet valve.

Another object is that both the connection of the valve plate to the aerosol container and the equipping of the valve plate with an outlet valve are to be simple in terms of their assembly engineering.

SUMMARY OF THE INVENTION

These objects are attained according to the invention in combination with an aerosol container having a mouth centered on an axis, by a plastic valve plate fitted to and tightly attached to the mouth and having a disk formed with an outlet centered on the axis, an outlet valve carried on the valve plate and having a housing holding a movable valve element, and a rigid extension integrally formed on the disk around the hole, projecting axially into the container, and forming a cavity in which the housing of the valve is fitted. A seal is fixed in the cavity between the housing and a surface of the extension forming the cavity.

According to the invention, after assembly, the housing is firmly braced in the cavity of the extension and presses against a seal that is between the housing and the valve plate. The seal is a seal ring, for example, that can be premounted on a front face of the housing. Alternatively, the seal can also consist of a seal component that is integrally formed on the valve plate. After assembly of the outlet valve, the extension substantially only is subjected to a traction load. The extension can therefore be relatively thin-walled. The housing is guided laterally in the cavity of the extension formed on the lower face of the disk and has at least one housing part that bears with its outer surface on an inner surface of the cavity.

The attachment of the housing with the cavity of the extension can be achieved in various ways. Advantageous embodiments are described below.

The housing can preferably be inserted like a plug into the cavity of the extension and be connected by at least one separate retaining element to the extension. The retaining element is a separate part. The connection can be achieved, for example, by mating pins, threaded pins or screws that are attached to the casing of the extension and engage the housing. The retaining means can also engage, for example, in holes, threaded holes or even into an annular groove on the outer surface of the housing. The mechanical connection can be either a detachable or as a non-detachable connection.

According to one preferred embodiment of the invention, the extension and the housing of the outlet valve are connected by a fork-shaped retaining spring that can be clipped on the outside of the extension, the retaining spring engaging through apertures of the extension and extending behind an axial mating surface of the housing. The retaining ring enables the outlet valve to be fixed axially and can be made of metal or plastic.

The housing and the extension can also be positively connected by their shape or by positive-fitting elements that are formed on the housing and/or the extension. Insofar as the housing part is not cylindrical, protection against relative rotation can simultaneously also be provided through form-fitting of the cavity, so that the housing can be attached to the valve plate in an axially and rotationally fixed manner. Particularly, the housing can have locking hooks that engage in recesses on the outer surface of the extension. The locking hooks can be arms that extend at a spacing from the outer surface of the housing parallel to the housing and engage from the outside in respective recesses of the extension.

A positive connection between the housing and the extension can also be achieved by providing the housing with a frustoconical outer surface and the cavity with a complimentary frustoconical inner surface, and by providing these surfaces with teeth that positively fix the outer surfaces of the cavity and of the housing that are in contact.

Another possibility for positive connection of the parts consists of heating and reshaping the free end of the extension after insertion of the housing. In that case, the free end of the extension has a profile produced by thermal shaping that positively engages around an annular shoulder on the outer surface of the housing.

The invention also includes structural embodiments on the inner surface of the extension and the outer surface of the housing having positive-fitting elements that engage with each other by rotation or straight-line movement in combination with rotation. For example, the outer surface of the housing can be provided with an external screwthread and the cavity of the extension can have a complementary internal screwthread. Furthermore, the connection can be a bayonet joint produced by a straight-line movement in conjunction with rotation.

Moreover, the housing and the extension can be connected together by an adhesive or by a weld. The basis of the following remarks is that the housing is connected adhesively to the extension or connected nonpositively to the extension by a weld. In one advantageous embodiment the housing has a flange that is connected adhesively to an annular front surface of the extension or joined thereto by a laser weld. According to another advantageous embodiment, the housing has a collar that externally surrounds the free end of the extension and is connected to the extension by an annular laser weld. The gap between the free end of the extension and the collar can also be used for gluing. In that case, the gap between the mutually engaging parts is filled by a hardened hot-melt adhesive. For the aerosol container to function, it is essential that the housing rest against the seal in the cavity with a defined force. In order to ensure this, the housing advantageously has a frustoconical outer surface that bears on a frustoconical inner surface of the cavity.

The disk of the valve plate preferably has stiffening ribs. The number, geometry and alignment of the stiffening ribs is selected such that sufficient dimensional stability is imparted to the disk to absorb axial forces produced by the pressure in the aerosol container and occurring both during assembly of the outlet valve and during filling of the aerosol container. The stiffening ribs can particularly extend radially from the hole.

The valve plate can be manufactured cost-effectively as a plastic injection-molded part. Particularly, it can be made from a fiber-reinforced plastic but can also be made from a plastic without fiber reinforcement. Plastics that are worthy of consideration are thermoplastic polymers, particularly polyethylene terephthalate (PTE), polyamide (PA), polyethylene (PE), polypropylene (PP) and polybutylene terephthalate (PBT). When using a multipart injection molding technique, the valve plate can have integrally formed seal components that consist, for example, of a thermoplastic elastomer, silicone rubber or rubber.

According to one preferred embodiment of the invention, the disk is outwardly convexly arcuate. The inventive shaping of the disk contributes to enabling the valve plate to be manufactured with little material usage.

Furthermore, the valve plate advantageously has a collar that abuts a container inner surface adjacent the mouth and is axially supported on the container wall. The valve plate is centered in the mouth by the collar. Such axial support facilitates, among other things, positioning of the valve plate during the assembly process.

The aerosol container can be made of metal or plastic. In the case of a metal container, it is advantageously connected positively to the valve plate by sheet-metal forming. If the valve plate is intended for a positive connection to a metal container, the valve plate advantageously has a collar with at least one radial rib flanged from the sheet-metal casing of the container and from a seal braced between the collar and the sheet-metal casing of the container.

If the container is made of plastic, several ways of connecting the valve plate to the container can be considered. For instance, the valve plate can be welded or connected adhesively to the plastic container. The thermal shaping of the valve plate creates a positive connection with the container edge. Moreover, it is possible to connect the valve plate to a container made of plastic by hot stamping. To connect the plastic plate to the preferably plastic container, a non-detachable screw connection or plug connection using a multiple-part clamp is also suitable. Structural embodiments for the connection of the valve plate to a container made of plastic or metal are described in patent claims 19 to 33 and explained below on the basis of embodiments.

The inventive measures, which relate to the connection between the housing and the valve plate on the one hand and to the edge-side attachment of the valve plate to the aerosol container on the other hand, can be combined with each other in any way.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
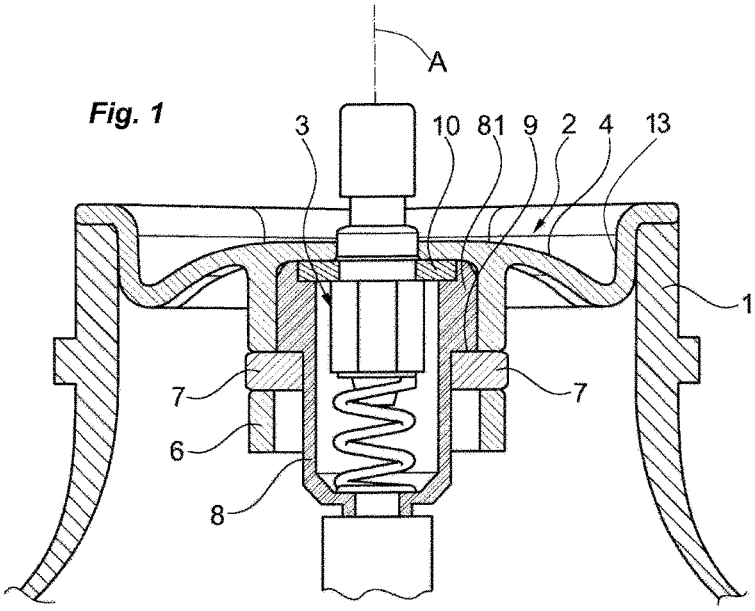
FIG. 1 is a longitudinal section through the mouth region of a container according to the invention.

As seen in FIG. 1 an aerosol container 1 has a mouth centered on an axis a and to which is tightly attached a valve plate 2 with an outlet valve 3. The valve plate 2 is made of plastic and has a disk 4 formed with a hole 5 for a valve element of the outlet valve 3. Formed on the lower face of the plate is a rigid tubular axial extension 6 forming a cavity for a housing 8 of the outlet valve 3. The housing 8 abuts a seal 10 at the outer axial end of the cavity and is mechanically fixed in the cavity. The housing 8 can be plugged into the extension 6 and has a housing part 81 that bears with its outer surface against a cylindrical inner surface of the cavity. Here, the housing part 81 and the cavity are cylindrical. However, it also lies within the scope of the invention if the cavity and the housing part 81 fitted therein has a cross section that differs from cylindrical so that the housing 8 is not only axially but also rotationally fixed to the valve plate 2.

The extension 6 and the housing 8 are connected by at least one separate retaining element. Here, the retaining element consists of a fork or U-shaped retaining spring 7 that can be clipped to the outside of the extension 6. FIGS. 1 and 2*a* to 2*c* so that the retaining spring 7 engages through radially throughgoing apertures 61 of the tubular extension 6 and fits behind an axially inwardly directed face 9 of the housing 8. The retaining spring 7 is a plastic element here. The connection formed by the retaining spring 7 is detachable.

Figure 3:
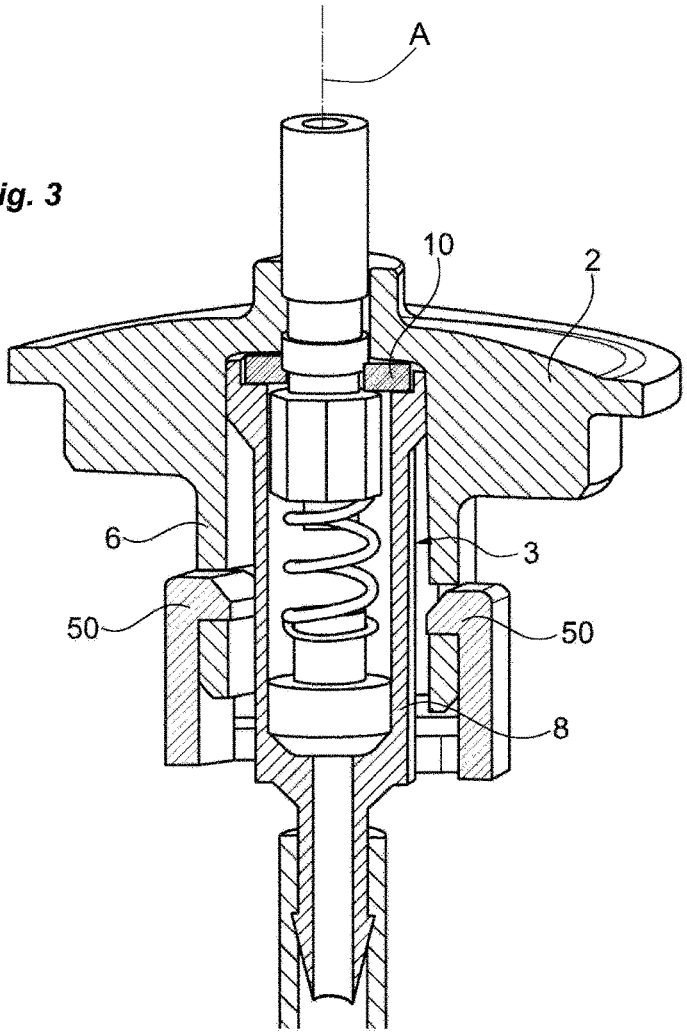
FIGS. 3 to 9 are partly sectional perspective views showing the valve plate, valve element and housing with different connections between the housing and the valve plate.

According to a modified embodiment shown in FIG. 3, the housing 8 has locking hooks 50 that engage in recesses on the outer surface of the extension 6. The locking hooks 50 are connected to the housing 8 via a support web. They extend outside the housing 8 parallel thereto and snap into the recesses on the outer surface of the extension 6.

Figure 4:
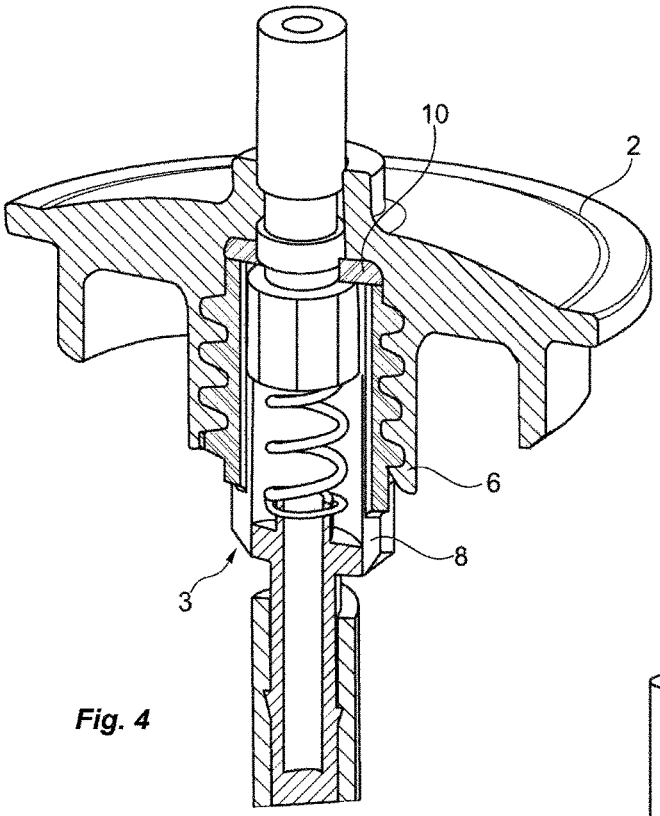

FIG. 4 shows another structural possibility for a positive connection between the housing 8 and the extension 6. The positive connection shown in FIG. 4 is a screw connection. The cavity of the extension 6 has an internal screwthread and the housing has a complementary external screwthread.

Figure 5:
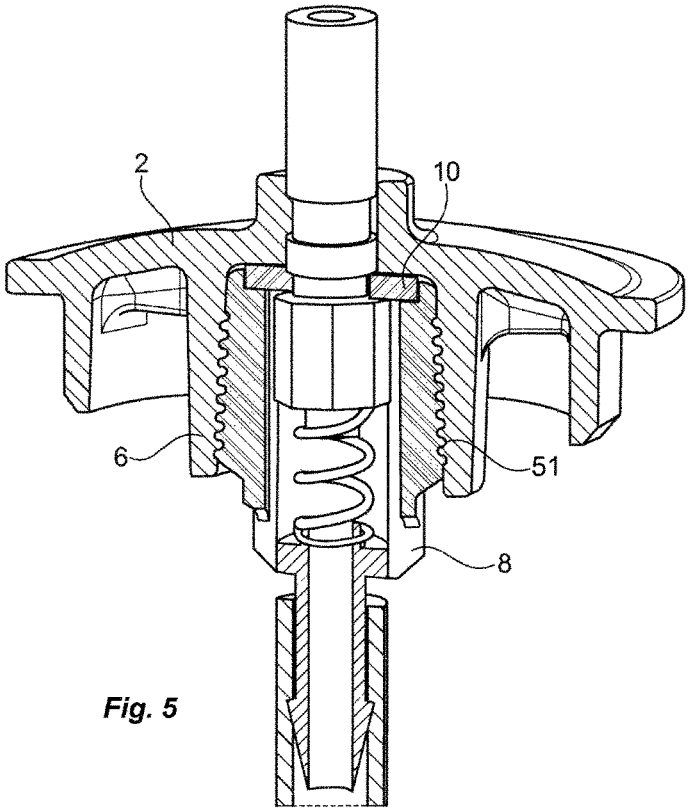

In FIG. 5, the housing 8 has a frustoconical outer surface and the cavity of the extension 6 has a complementary frustoconical inner surface. The surfaces are provided with teeth 51 that positively relatively fix the contacting surfaces of the cavity and of the housing 8.

Figure 6:
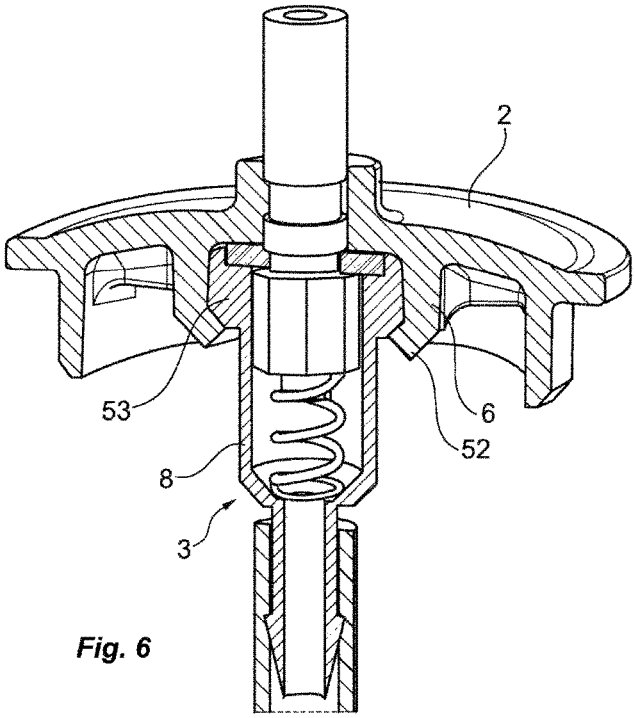

FIG. 6 shows another structural possibility for positively connecting the housing 8 and the extension 6. In FIG. 6, the free end of the extension 6 has an inwardly projecting annular ridge profile 52 made by thermal shaping that positively engages around an annular shoulder 53 on the outer surface of the housing 8.

Figure 7:
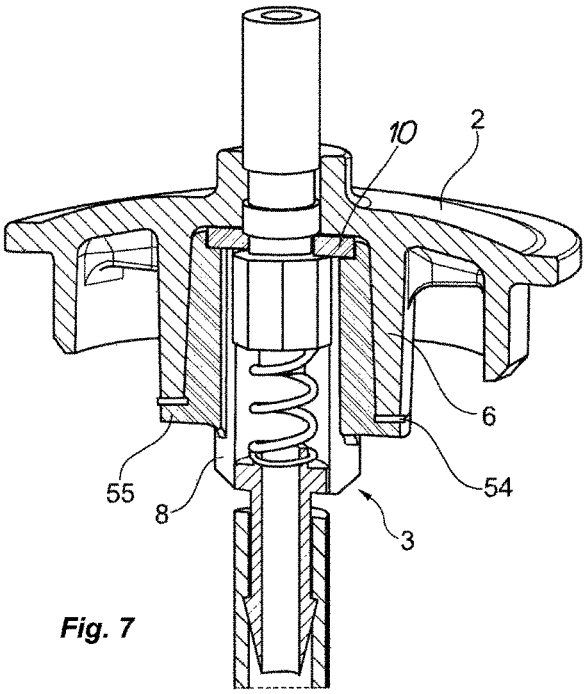
Figure 8:
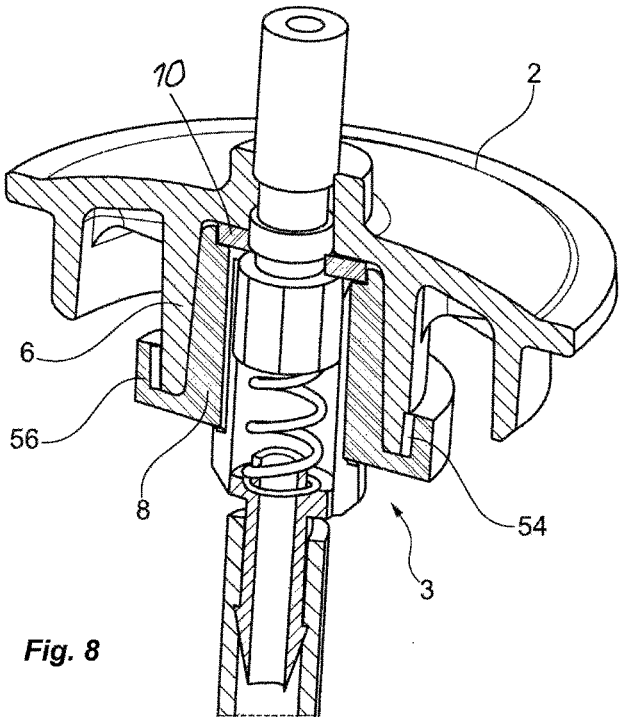
Figure 9:
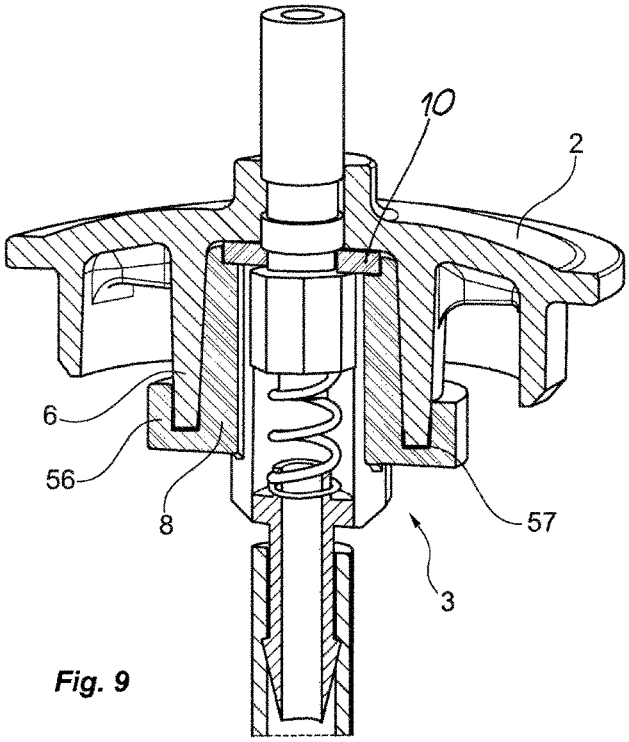

The housing 8 can also be glued to the extension 6 or can be connected to the extension 6 by a weld. FIGS. 7 to 10 show advantageous embodiments of weld and glue connections. In FIG. 7, the housing 8 has a flange 55 that is connected to an annular end face of the extension 6 by gluing or by a laser weld 54. According to the illustration in FIG. 8, the housing 8 has a collar 56 that annularly surrounds the free end of the extension 6 and is connected to the extension 6 by a peripheral laser weld 54. In FIG. 9 as well, the housing 8 has a collar 56 that annularly surrounds the free end of the extension 6. The gap between the mutually engaging parts is filled in this embodiment by a hardened hot-melt adhesive 57. In the modified embodiments shown in FIGS. 7 to 9, the housing 8 has a frustoconical outer surface and abuts a complementary frustoconical inner surface of the cavity. The mutual engagement of two frustoconical surfaces forms a defined seal gap in the cavity that is filled by the seal 10. Defined pressing forces act upon the seal 10.

In all of the embodiments, the disk 4 of the valve plate 2 has stiffening ribs 12 extending radially from the hole 5. According to FIGS. 2*b* and 2*c*, the stiffening ribs 12 are on the lower or inner face of the disk. However, the stiffening ribs 12 can also be on the upper face of the disk 4 or both on the upper and on the lower faces of the disk 4. The stiffening ribs 12 impart sufficient dimensional stability to the valve plate 2 for withstanding the container internal pressure and for withstanding axial forces that can occur during the assembly of the outlet valve 3 on the valve plate 2 and during filling of the aerosol container by a filling system.

Figure 2A:
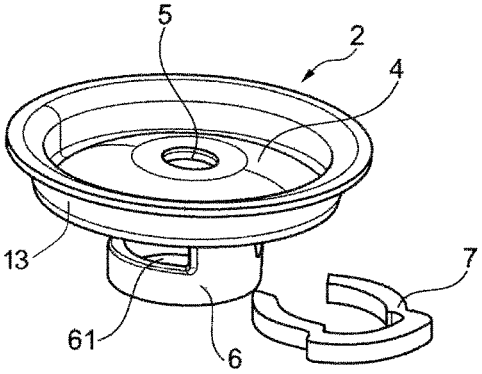
FIGS. 2*a* and 2*b* are top and bottom perspective views of a valve plate for the container shown in FIG. 1.
Figure 2B:
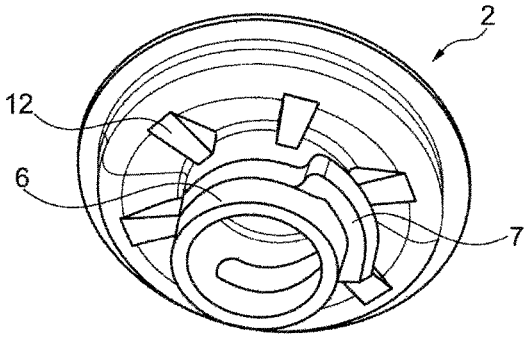
Figure 2C:
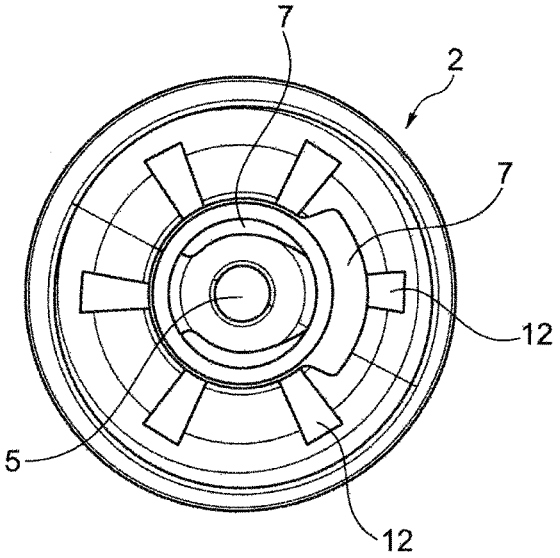
FIG. 2*c* is a top view of the valve plate of FIGS. 2*a* and 2*b;*

The valve plate 2 shown in FIGS. 2*a* to 2*c* has a short cylindrical collar 13 that bears radially outwardly against a container inner surface adjacent the mouth and is braced axially against the container wall. The disk 4 of the valve plate 2 is outwardly arcuately convex.

The valve plate 2 is made of a fiber-reinforced plastic. Examples of suitable plastics are polyethylene terephthalate (PET), polypropylene (PP), polyethylene (PE), polyamide (PA) and polybutylene terephthalate (PBT), and the fibers can make up 30 to 40% by weight. Depending on requirements, unreinforced plastic can also be used. The valve plate 2 is preferably manufactured by injection molding.

Figure 10:
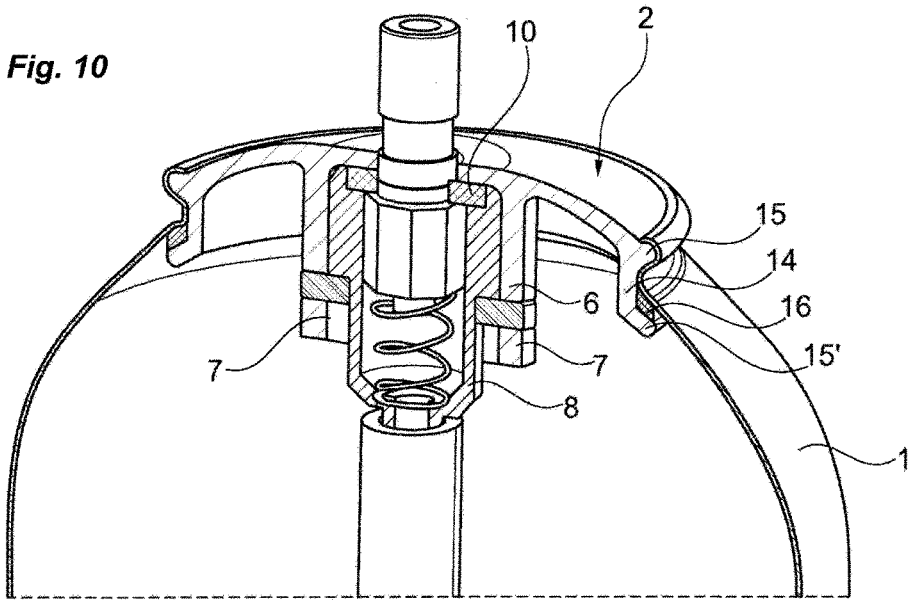
FIGS. 10 to 21 are further detail sectional views illustrating embodiments of the container of FIG. 1.

The aerosol container 1, hereinafter can be made of metal or plastic. FIG. 10 shows a metal container 1 that is positively connected to the valve plate 2 by sheet-metal shaping. The valve plate 2 has a collar 14 with two radially outwardly projecting annular ribs 15, 15'. One rib 15 is gripped by a rolled edge of the sheet-metal container 1 and a seal 16 is braced between the collar 14 and the sheet-metal casing of the container 1.

Figure 11:
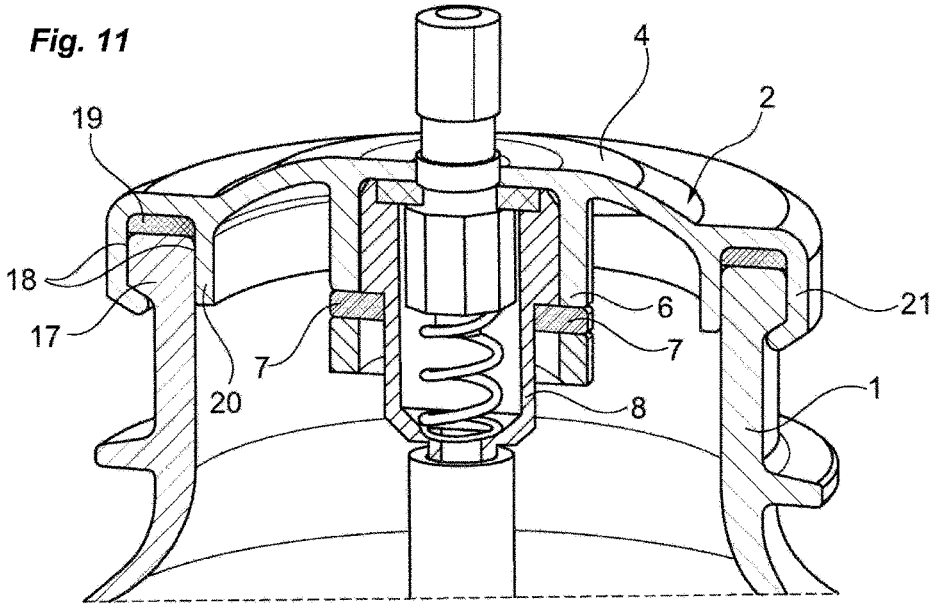

In FIG. 11, the container 1 is made of plastic and has a mouthpiece 17 that engages in an annular groove 18 of the valve plate 2 and axially bears against a seal 19 in the annular groove 18. The seal 19 can be fitted into the annular groove as a separate seal ring or can consist of a seal component that is integrally formed on the valve plate 2 or injected before assembly into the annular groove 18 and hardened chemically or thermally or using special light. The annular groove 18 is bordered by an inner collar 20 of the valve plate 2 adjacent the container inner wall and by an outer collar 21. The outer leg 21 has a profile produced by thermal shaping that positively engages around the mouthpiece 17 of the container 1.

Figure 12:
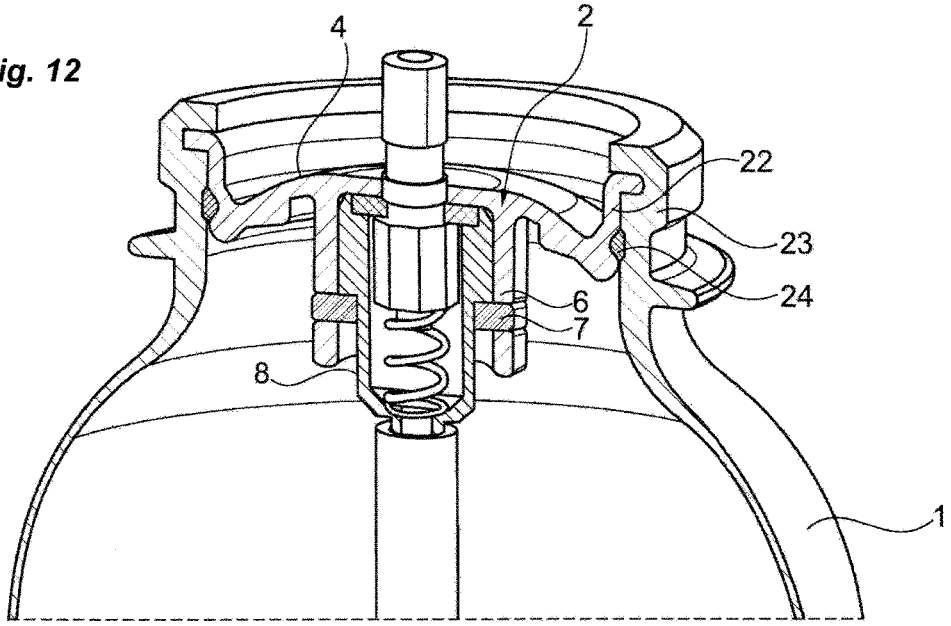
Figure 12A:
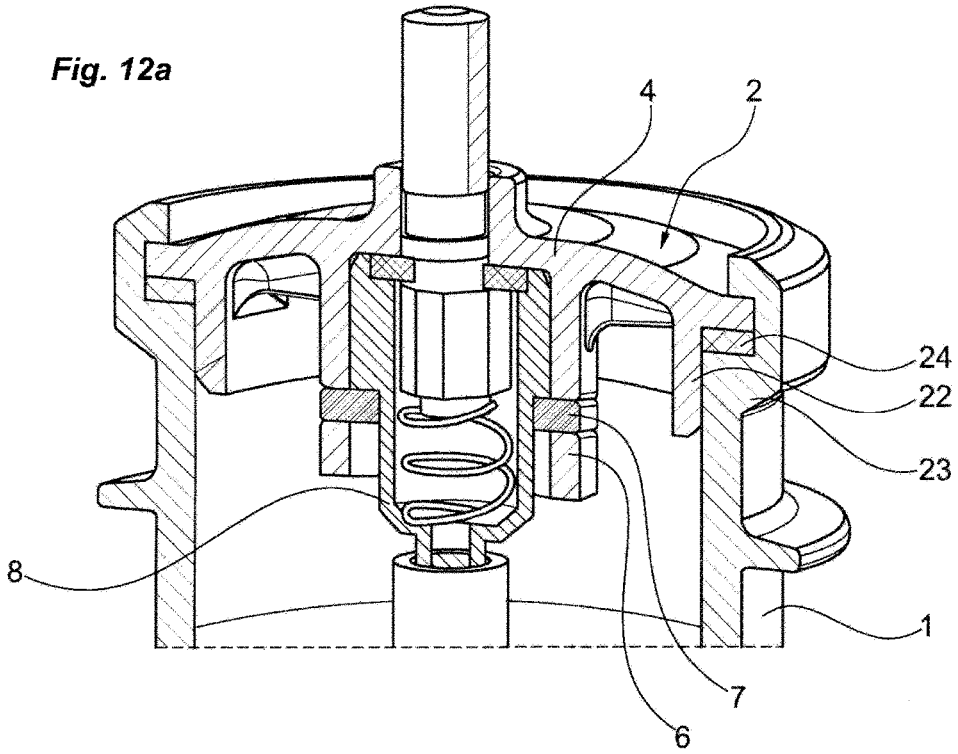

In FIG. 12, the aerosol container 1 is also made of plastic. The valve plate 2 has a collar 22 connected by hot stamping to a mouthpiece 23 of the container 1. A seal 24 is between the collar 22 of the valve plate 2 and the inner surface of the container 1. This seal 24 can be a seal ring. In particular, the seal 24 can also be made of a thermoplastic elastomer that has been integrally formed on the valve plate 2 in a multipart injection-molding process, for example. One design variant is illustrated in FIG. 12*a*. Here, the seal 24 is integrally formed on an annular bearing surface of the valve plate.

Figure 13A:
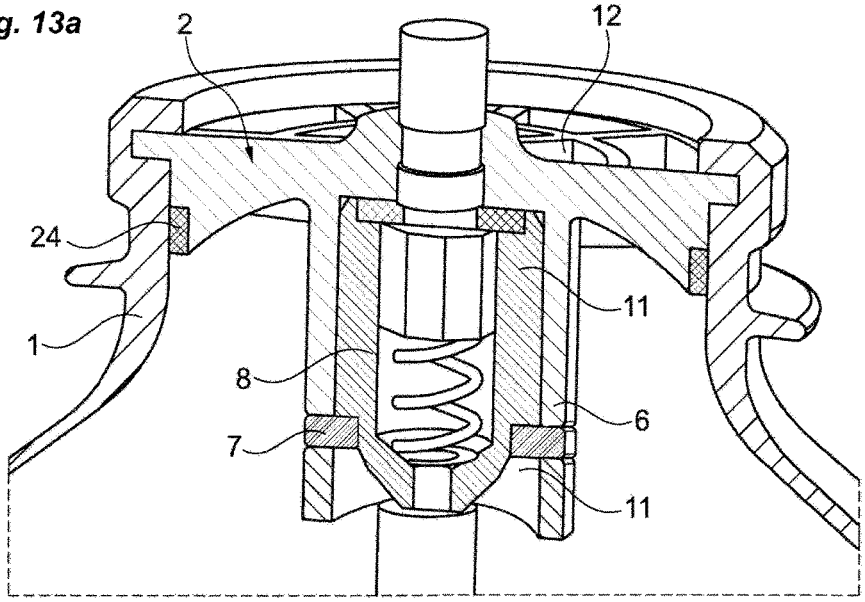
Figure 13B:
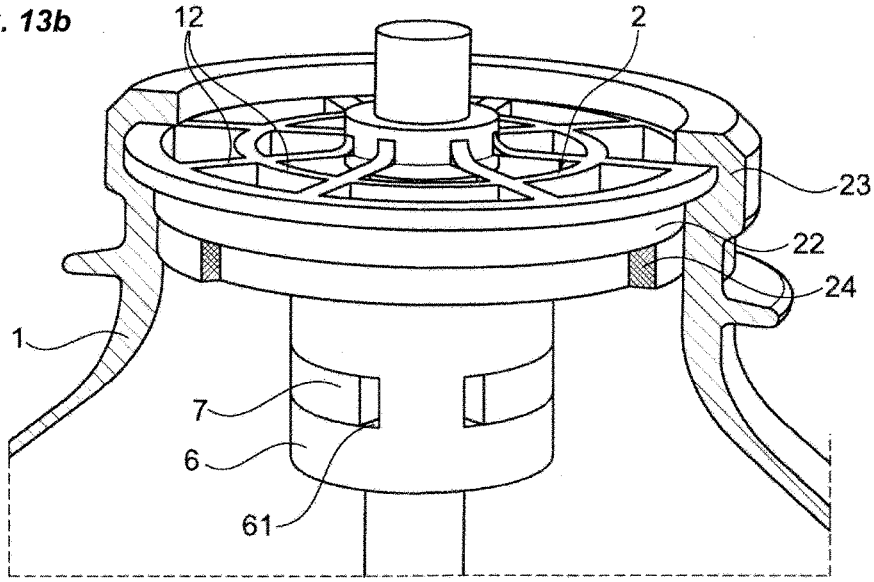

FIGS. 13*a* and 13*b* also show a valve plate 2 that has been connected by hot stamping to the mouthpiece 23 of the plastic container 1. The seal 24 is an elastic that is integrally formed on the valve plate 2. The valve plate 2 has stiffening ribs 12 both on the upper and lower faces of the disk 4. An arrangement of annular stiffening ribs and stiffening ribs extending radially from the hole are provided.

Figure 14:
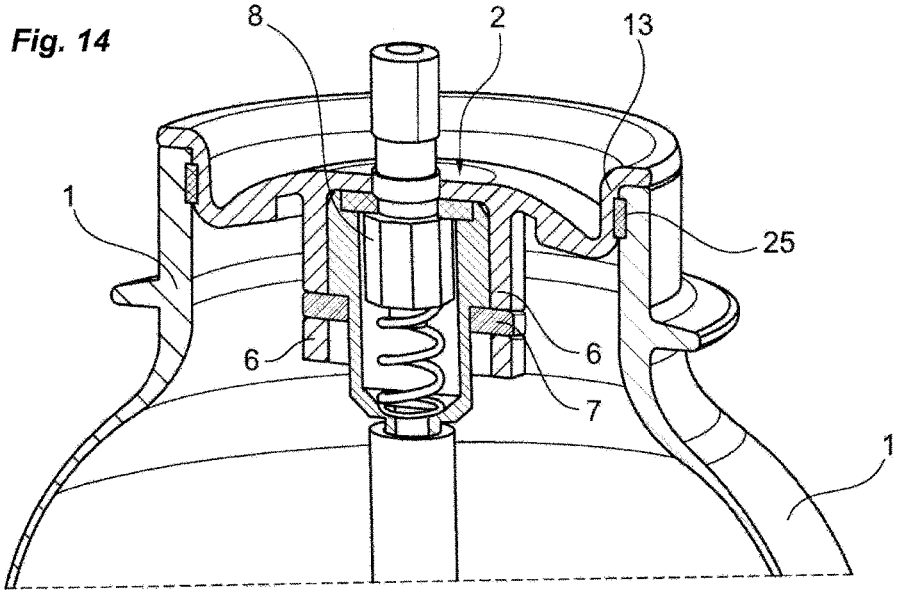
Figure 14A:
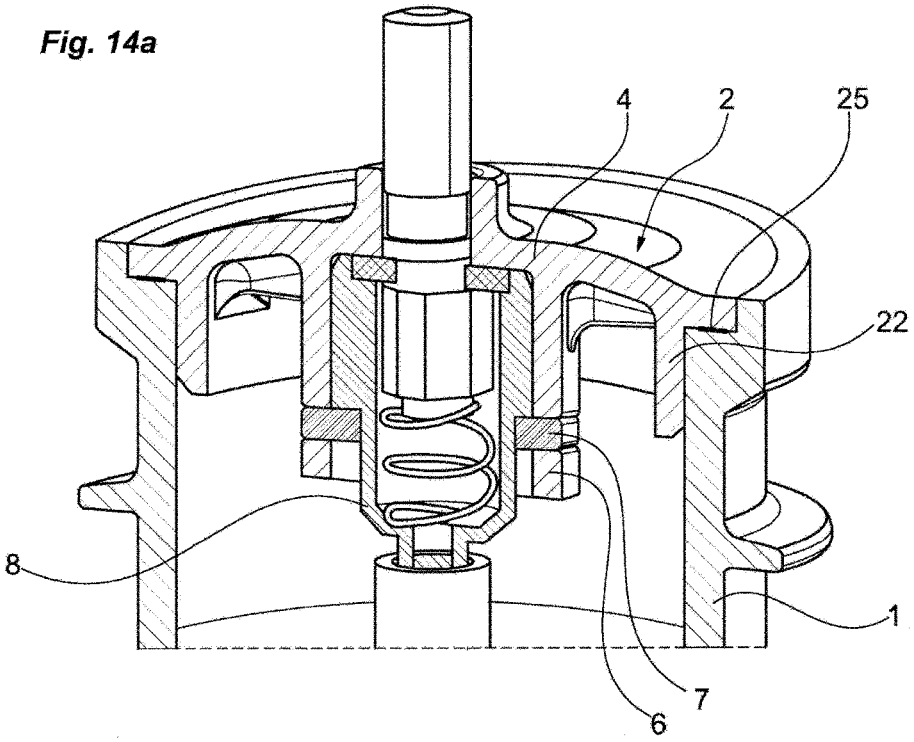

In FIG. 14, the valve plate 2 is connected by a laser weld 25 to the plastic container 1. The laser weld 25 connects the collar 13 of the valve plate 2 that abuts a container inner surface adjacent the mouth. The laser weld 25 can be produced using a radial laser welding process in which the laser beam is deflected by a mirror in such a way that it radially strikes the rotationally symmetrical surface of the parts to be welded. Alternatively, laser welding processes can also be used in which the workpiece is rotated about its longitudinal axis around a stationary such mirror. With the aid of the laser welding method, a pressure-tight permanent connection can be made. Additional seals can be omitted. The weld can be produced with short cycle times. The wall of the container 1 must be laser-permeable, whereas the valve plate 2 is made of a laser-absorbing material. According to one design variant illustrated in FIG. 14*a*, the laser weld 25 is on an annular front edge.

Figure 15:
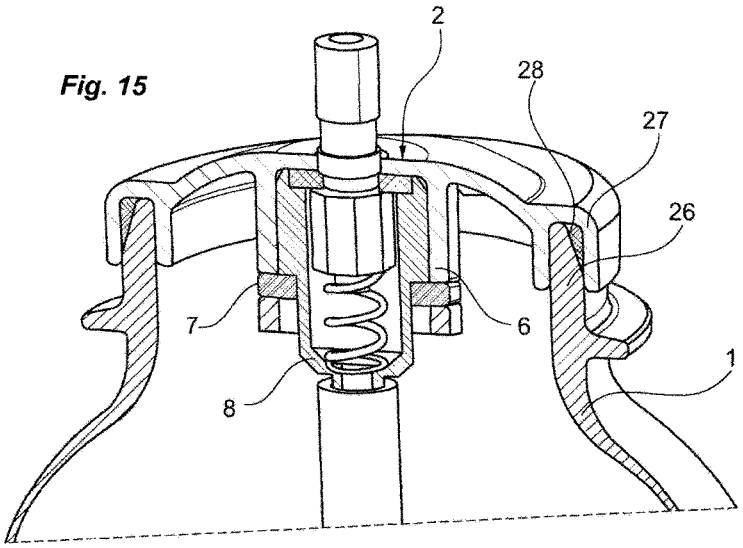
Figure 16:
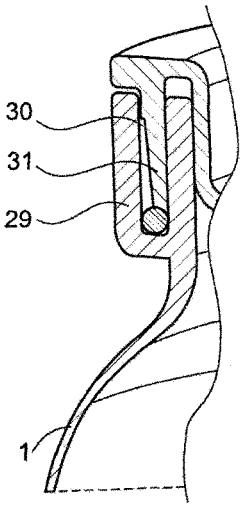

FIGS. 15 and 16 show adhesive connections between the valve plate 2 and a plastic aerosol container 1. In FIG. 8, the edge 26 of the container 1 around the mouth engages in an annular groove 27 of the valve plate 2, the gap between the mutually engaging parts being filled with a hardened hot-melt adhesive 28. To produce the adhesive connection, a welding auxiliary body is placed into the annular groove 27. It is liquefied by inductive heating of the welding auxiliary body and fills the gap between the parts to be connected. This results in a very strong permanent adhesion that is heat- and impact-resistant.

According to the illustration in FIG. 16, the container has a collar 29 with at least one pocket 30 that can be formed as an annular gap. The valve plate 2 rests on the collar 29 and has a connection element 31 engaging in the pocket 30. The gap of the mutually engaging parts is filled with a hardened hot-melt adhesive 28. The adhesive connection is produced in the same way as described above.

Figure 17:
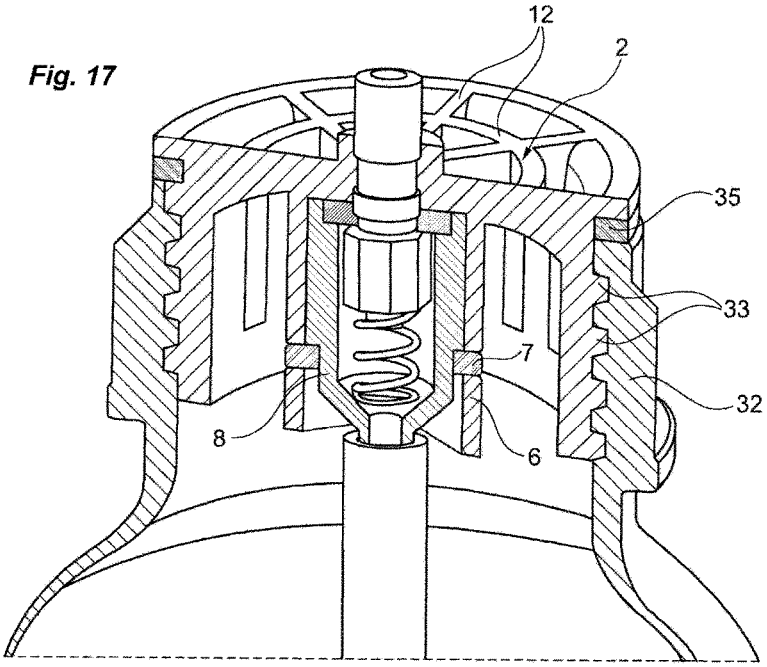
Figure 18:
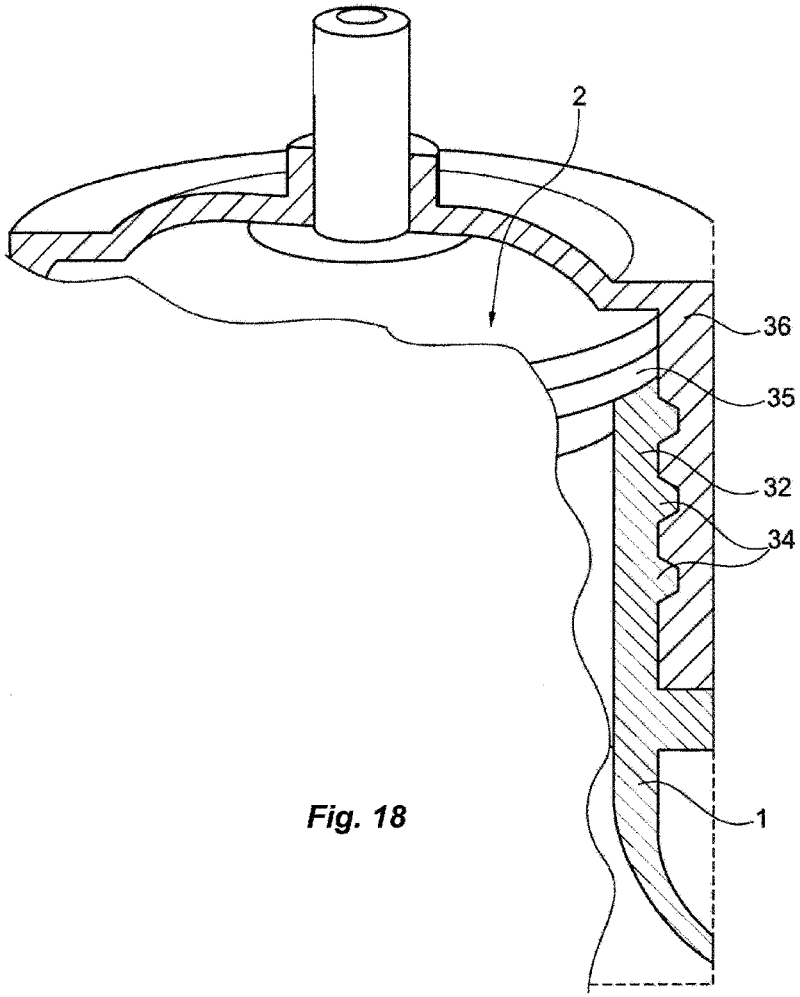

FIGS. 17 and 18 relate to screw connections between the valve plate 2 and the aerosol container 1. The latter is embodied as a blown plastic container and has a collar 32 with a screwthread that can be an internal screwthread 33 or external screwthread 34. In FIG. 17, the screwthread is an internal screwthread 33. The valve plate 2 is connected by a fixed screw connection to the collar 32, with a seal 35 between the collar 32 and the valve plate 2. In FIG. 18, the screw connection comprises a coupling nut 36 that is screwed onto an external screwthread 34 of the collar 32 and clamps the valve plate 2 with the collar. Here as well, a seal 35 is between the collar 32 and the valve plate 2. The screw connections illustrated in FIGS. 17 and 18 are non-detachable. They have locking formations that prevent rotational movement of the screw-connectable parts in the opening direction.

Instead of a screw connection, a positive connection by a bayonet joint is also possible.

Figure 19A:
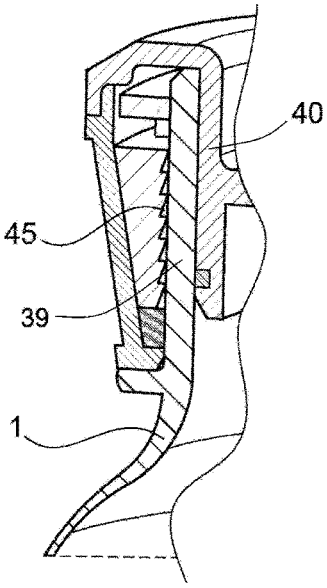
Figure 19B:
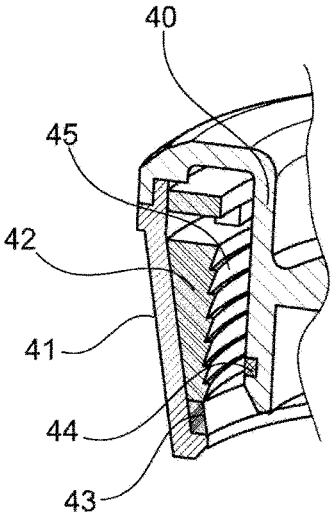

FIG. 19*a* shows a plug connection using a set of clamp elements for connecting the valve plate 2 to a plastic container. The plastic aerosol container 1 has a cylindrical neck 39 into which a collar 40 of the valve plate 2 engages. An external clamping ring 41 is connected to the valve plate 2, surrounds the neck 39, and borders a wedge-section annular space between the neck 39 and the external clamping ring 41. The external clamping ring 41 is rigidly connected to the valve plate 2, for example by a laser weld. An internal clamping ring 42 is in the external clamping ring 41 that fills the wedge-section annular space. The arrangement illustrated in FIG. 19*b* must still be completed by the assembly of an outlet valve and can then be pushed onto the neck 39. On reaching the position of FIG. 19*a*, the arrangement can no longer be pulled off of the neck 39 since the internal clamping ring 42 wedges the external clamping ring 41 with the neck 39. When the interior of the container 1 is pressurized after the container is filled, forces are exerted against the valve plate 2 and the neck 39. As a result of these forces, the parts 39, 41, 42 wedge against each other.

A seal 43 is in the wedge-section annular space that is deformed by an axial relative movement of the two clamping rings 41, 42 and abuts an inner surface of the external clamping ring 41 and an outer surface of the neck 39. Furthermore, at least one ring seal 44 is on the collar 40 of the valve plate 2 that abuts the inner surface of the neck 39. Finally, the confronting surfaces of the internal clamping ring 41 and of the neck 39 have sawtooth profiling 45 for locking the parts 41 and 40 together. The connection can no longer be detached after assembly. The internal pressure prevailing in the container after the aerosol container is filled strengthens the clamping effect arising between the parts.

Figure 20:
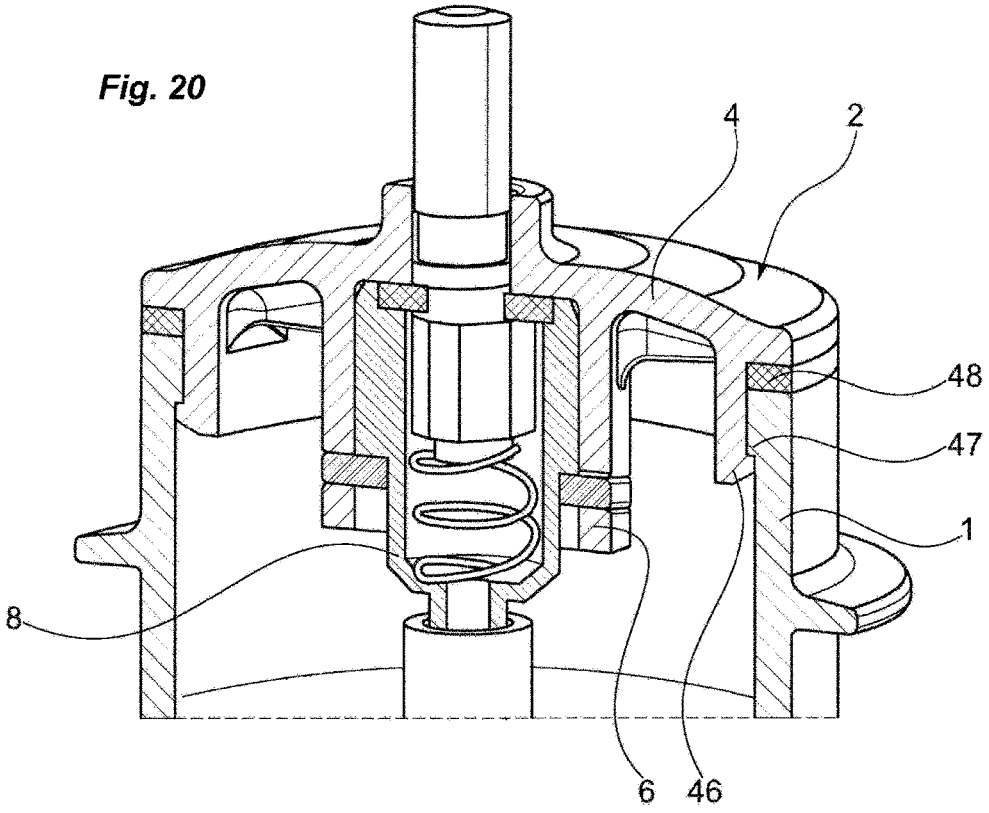
Figure 21:
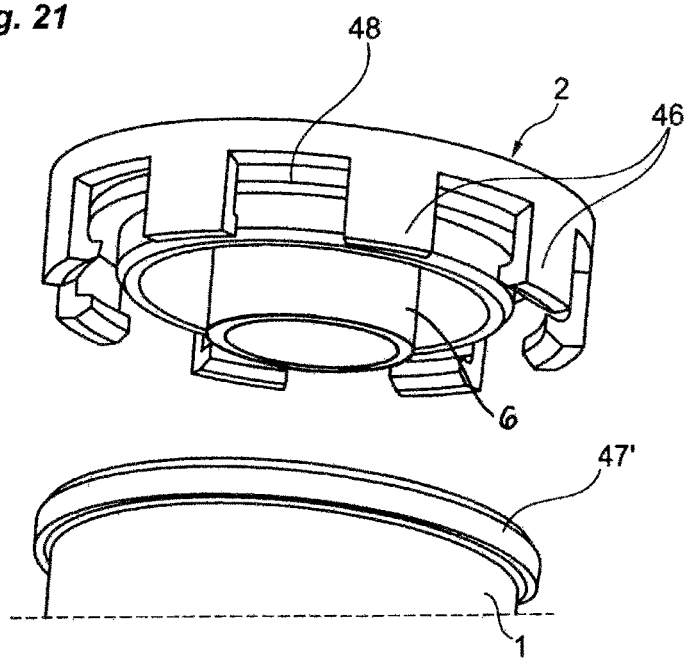

The valve plate can also be connected to the aerosol container by a snap-on connection. In FIG. 20, the valve plate 2 has locking hooks 46 that extend behind an annular flange 47 of the container on the inside of the container. The snap-on connection on the inside of the container is inaccessible from outside and not detachable. Furthermore, an elastomeric sealing surface 48 is integrally formed on the valve plate 2. According to the illustration in FIG. 21, the locking hooks 46 can also extend behind an annular mouth 47' on the outside of the container. To secure a snap-connection on the outside of the container, a clamping ring (not shown) can be used which prevents the locking hooks from bending upward

We claim:

1. In combination with an aerosol container having a mouth centered on an axis, a plastic valve plate fitted to and tightly attached to the mouth and having a disk formed with an outlet centered on the axis;

an outlet valve carried on the valve plate and having a housing holding a movable valve element and formed with an axially inwardly directed face;

a rigid tubular extension integrally formed on the disk around the hole, projecting axially inward into the container, formed with diametrally opposite through-going apertures, and forming a cavity in which the housing of the valve is fitted;

at least one separate fork- or U-shaped retaining spring that can be clipped on the outside of the extension so as to engage radially inward through the apertures so as to bear axially outward on the face of the housing to fix the housing in the extension; and a seal fixed in the cavity between the housing and a surface of the extension forming the cavity.

2. The combination defined in claim 1, wherein the valve plate has a collar that bears against a container inner surface adjacent the mouth and is radially supported on an inner surface of the container.

3. The combination defined in claim 1, wherein the container has an edge defining an annular groove in which the mouth engages, a gap between the valve plate and container being filled by a hardened hot-melt adhesive.

4. The combination defined in claim 1, wherein the container is made of metal and is positively connected to the valve plate by sheet-metal shaping.

5. The combination defined in claim 4, wherein the valve plate has a collar with at least one radially inwardly projecting rib that is flanged from the sheet-metal casing of the container and the combination includes another seal braced radially between the collar and the sheet-metal container.

6. The combination defined in claim 1, wherein the container is made of plastic and has a mouthpiece that engages in an annular groove of the valve plate and bears on a second seal in the annular groove, the annular groove being bordered by a collar bearing against the container inner wall and by an outer leg that has a profile made by thermal shaping that positively engages around the mouthpiece of the container.

7. The combination defined in claim 6, wherein the valve plate has a collar connected by hot stamping to a mouthpiece of the container, the second seal being between the collar of the valve plate and a surface of the container.

8. The combination defined in claim 1, wherein the container has a collar with at least one pocket and the valve plate rests on the collar and has a screw connection element engaging in the pocket, a gap between the plate and the container being filled by a hardened hot-melt adhesive.

9. The combination defined in claim 8, wherein the screw connection element comprises a coupling nut that is screwed onto a screwthread of the collar and presses the valve plate against the collar.

10. The combination defined in claim 1, wherein the container is made of plastic and has a cylindrical neck, the combination further comprising:

a collar on the valve plate fitting in the mouth of the container; and an external clamping ring connected to the valve plate, surrounding the neck, and defining therewith a wedge-section annular space between the neck and the external clamping ring, and an internal clamping ring in the external clamping ring and at least partially filling the wedge-section annular spaces.

11. The combination defined in claim 10, further comprising:

a ring seal in the wedge-section annular space, deformed by axial relative movement of the two clamping rings, and bearing against an inner surface of the external clamping ring and an outer surface of the neck.

12. The combination defined in claim 11, wherein the ring seal on the collar of the valve plate bears against the inner surface of the neck.

13. The combination defined in claim 11, wherein radially confronting surfaces of the internal clamping ring and of the neck have formations for locking the external ring and neck against axial separation.

14. The combination defined in claim 11, wherein the ring seal is integrally formed on the valve plate.

* * * * *